United States Patent [19]

Lüttgens

[11] Patent Number: 4,513,798

[45] Date of Patent: Apr. 30, 1985

[54] SHARPENER, SPECIFICALLY FOR COSMETIC STICKS

[75] Inventor: Werner Lüttgens, Erlangen, Fed. Rep. of Germany

[73] Assignee: A. Klebes GmbH & Co. K.G. Kunststoff- und Metallwarenfabrik, Erlangen, Fed. Rep. of Germany

[21] Appl. No.: 442,605

[22] Filed: Nov. 17, 1982

[30] Foreign Application Priority Data

Nov. 17, 1981 [DE] Fed. Rep. of Germany ..... 3145536

[51] Int. Cl.[3] ..... B43L 23/00

[52] U.S. Cl. ..... 144/28.11; 144/28.1

[58] Field of Search ..... 144/28.1, 28.11, 282, 144/30; 145/3.3, 3.31, 3.32

[56] References Cited

U.S. PATENT DOCUMENTS

| | | | |
|---|---|---|---|
| 1,154,325 | 9/1915 | Casse | 145/3.3 |
| 4,081,010 | 3/1978 | Galli | 145/3.3 |
| 4,124,048 | 11/1978 | Fischer | 144/28.11 |
| 4,406,315 | 9/1983 | Brickhouse | 145/3.61 |

FOREIGN PATENT DOCUMENTS

| | | | |
|---|---|---|---|
| 2734695 | 2/1979 | Fed. Rep. of Germany | 144/28.11 |

*Primary Examiner*—W. D. Bray
*Assistant Examiner*—Jorji M. Griffin
*Attorney, Agent, or Firm*—Spencer & Frank

[57] ABSTRACT

A sharpener for sharpening an end of a writing stick by inserting the writing stick into the sharpener in a retentive or friction locking manner and rotating the sharpener and writing stick relative to each other, the sharpening of the writing stick generating waste material. The sharpener includes a sharpener body having an insertion end with an opening for receiving the end of the writing stick and a longitudinal axis extending through the opening. A sharpening blade is mounted on the body with its cutting edge arranged at an acute angle with respect to the longitudinal axis of the body. A chip collecting cap has an interior wall and is mounted on the body for enclosing an end of the body remote from the insertion end. A mechanism is provided for selectively securing and releasing the chip collecting cap with respect to rotation about the longitudinal axis of the body and a scraper is disposed at the body adjacent the interior wall of the chip collecting cap for scraping the waste material from the interior wall when the chip collecting cap is rotated relative to the sharpening body.

17 Claims, 5 Drawing Figures

SHARPENER, SPECIFICALLY FOR COSMETIC STICKS

BACKGROUND OF THE INVENTION

The invention relates to a sharpener for a writing stick, particularly for a cosmetic stick having a soft interior, wherein the sharpener includes a blade supporting body placed on the stick and a chip collecting cap removably secured to the blade supporting body. The sharpener thus forms a protective cap for the stick and permits the stick to be sharpened by relative rotation of the stick with the blade supporting body, with the chips being deposited in the chip collecting cap.

A sharpener of the above-mentioned type for cosmetic sticks is disclosed in German Offenlegungsschrift No. 2,953,022, which when in the attached position, protects the stick which is generally soft and therefore very susceptible to breaking. To be sharpened, the stick need only be rotated in the sharpener that has been placed onto its tip. The sharpening waste created thereby is collected within the attached chip collecting cap without being able to soil, for example, a pocketbook, cosmetic case or the like. The chip collecting cap is here essentially designed as a hollow cylinder with a closed end which surrounds the blade side of the sharpener so as not to project too far in a direction radial to the axis of the sharpener or stick, respectively, and thus take up the smallest possible space in the pocketbook or the like. The term cosmetic sticks is here understood to generally mean sticks having a greasy, sometimes sticky interior and a wood or plastic casing.

Because of the desirable small volume of the known attachable sharpener with chip collecting cap, the chip collecting volume of the latter is limited. After a few sharpening processes, the sharpening waste must be removed from the chip collecting cap which, however, experience has shown, is often not done due to inattention. The clogging of the chip collecting cap with sharpening waste is often noted only when the sharpener exhibits an increasing inability to function, i.e. no longer furnishes a satisfactory sharpening result. The observed inattention is furthered by the fact that for aesthetic reasons, the chip collecting cap is frequently not made of a transparent or translucent material. Rather, for aesthetic reasons, such caps are usually made either of sheet metal or plastic with a metallized, e.g. gold or silver colored, surface.

Once the elongate, particularly hollow cylinder shaped sleeve, which has a comparatively small diameter, has become clogged with the soft, sticky mass of the stick interior or with wood chips penetrated with such stick material, it is practically impossible to remove the sharpening waste without the aid of a cleaning instrument. In any case, due to the soft, viscous consistency of the interiors of cosmetic sticks, it cannot be expected with certainty, even if the chip collecting cap is filled loosely, that shaking of the removed cap will suffice to remove, without the aid of an instrument, the sharpening waste adhering—albeit only in part—to the walls of the chip collecting cap. The conical shape of the end of the sharpener facing the chip collecting cap even enhances the above-described plugging or clogging of the chip collecting cap.

SUMMARY OF THE INVENTION

It is an object of the invention to provide a sharpener of the above-mentioned type in such a way that the chip collecting cap, even after it has been plugged or clogged with sharpening waste, can be easily freed of even stubbornly adhering sharpening waste without the aid of an instrument foreign to the sharpener. This is accomplished by the present invention wherein scraping means are disposed at the sharpener body and adjacent the interior wall of the chip collecting cap for scraping waste material from the interior wall when the chip collecting cap is rotated relative to the sharpener body.

Although the considerations on which the invention is based are described here in connection with a sharpener for cosmetics, the same also applies, of course for sharpeners for sharpening grease pencils, for example, where similar problems occur. In the sharpening position, the chip collecting cap is fastened on the sharpener in a position in which it is secure against rotation—be this by form lock or by a firm friction lock. This is necessary primarily because, for the purpose of sharpening, the operator must transfer the sharpening moment to the handy cap from which it must be transmitted to the sharpener. Only, for example, after a slight pull or, with a threaded fastening according to German Pat. No. 344,989, after turning in the reverse of the fastening direction, is the security of the connection against rotation removed in such a manner that the chip collecting cap can be rotated relative to the sharpener or removed completely. Then, according to one embodiment of the invention a side edge of the sharpener body acts, so to speak, as a scooping or scraping edge and, in the latter case, removes the sharpening waste adhering to the interior wall of the chip collecting cap. This sharpening waste remains on the surface of the scoop-like sharpener member supporting the side edge and is there possibly compressed somewhat. If the sharpener is then removed completely from the chip collecting cap, the sharpening waste rests on the portion of the sharpener which, in the use position, lies within the chip cap and has the scoop-like effect; from there, the waste can easily be removed without the aid of a special tool, for example onto toilet paper. Although in the above the effect of the side edge of the sharpener member has been called scraper-like, this does not necessarily mean that contact must exist between this side edge and the interior wall of the chip collecting cap. Rather, the desired loosening or cleaning effect is realized even if the side edge extends at a certain distance from the interior wall of the chip collecting cap and thus produces at least a scoop-like effect.

According to another aspect of the invention the sharpening waste is directed right from the start in the direction toward the above-mentioned removal side edge in that the side edge extends approximately in the plane of the sharpening blade. The sharpening waste, when the chip collecting cap is clogged, is pressed into longitudinal regions of the cap which lie outside the longitudinal region of the sharpening blade. Another feature of the invention overcomes this problem by extending the desired cleaning effect at least almost over the entire effective receiving length of the chip collecting cap. In a further aspect of the invention, a planar region is formed on both sides of the sharpening blade in the plane of the sharpening plane. This region has the shape of a tray and extends at least into the vicinity of the interior wall of the chip collecting cap so that the sharpening waste can be deposited there to then be easily stripped off in one sweep when the sharpener is released from the chip collecting cap.

According to another embodiment of the invention, the basic sharpener body includes a cleaning projection which projects into the collecting cap essentially in the axial direction. The cleaning projection may be used in the manner of a cleaning pick. As disclosed in German Offenlegungsschrift No. 3,004,020, the sharpener itself may be equipped with a separate cleaning rod which is pushed through a holding eye and, when separated, can be used in a known manner to clean out the sharpening slit disposed in front of the cutting blade, as this slit is particularly easily clogged and soiled by sharpening waste. According to this embodiment of the invention, however, this cleaning rod, when in its rest position, can also exert a loosening, scraping, collecting and/or removing effect on the sharpening waste.

Preferably the cleaning rod extends over the entire length of the collecting cap which enhances the most complete cleaning effect. When in the inserted end position, the cleaning rod can also be used to produce a rotationally secure retentive or friction lock between chip collecting cap and sharpener, in that it is wedged in at least with respect to one of these two members. A particularly handy actuation of the sharpening and cleaning process is provided in that the chip collecting cap has a rotationally symmetric interior cross section, particularly the cross section of a hollow cylinder. The sharpener can be fastened to aside pocket so as to secure it against loss by providing the cap, for example, with a chip. To protect against loss of the chip collecting cap it may be connected with the sharpener body by a pull apart connecting means. Additionally, the sharpener can be placed securely, with the retentive and/or friction lock required for its various functions, onto sticks having slightly different exterior diameters due to the provision of a slitted projection sleeve which defines the opening in the sharpener body. Slide and clamp humps are distributed over the inner circumference of the projection sleeve to regulate the retentive effect without impeding rotatability. According to another feature of the invention a sealing cap is provided so that the sharpener can be closed in a position removed from the stick to prevent sharpening waste from escaping from the stick insertion opening and the soiling of for example, a pocket.

Due to the shape of the closing cap the closing cap, instead of the sharpener itself, can be placed onto one of the ends of the stick in a manner secure against loss to thereby protect, for example, the sharpened stick interior against external damage. The closing cap is further constructed so that the sharpened stick interior is held at a safe distance from the circumferential walls of the closing cap.

Finally, the basic body of the sharpener is made of several components, including a guide sleeve so that the same basic sharpener body permits use of the sharpener with sticks of different outer diameters. Only the guide sleeve must be adapted to the respective stick diameter. The adaptability of the sharpener to different stick diameters can also be accomplished by the provision of an adapter sleeve for use with the guide sleeve.

BRIEF DESCRIPTION OF THE DRAWINGS

The subject matter of the invention will be explained in an exemplary manner with the aid of the drawings. These show in.

DESCRIPTION OF THE PREFERRED EMBODIMENTS

Figure 1:
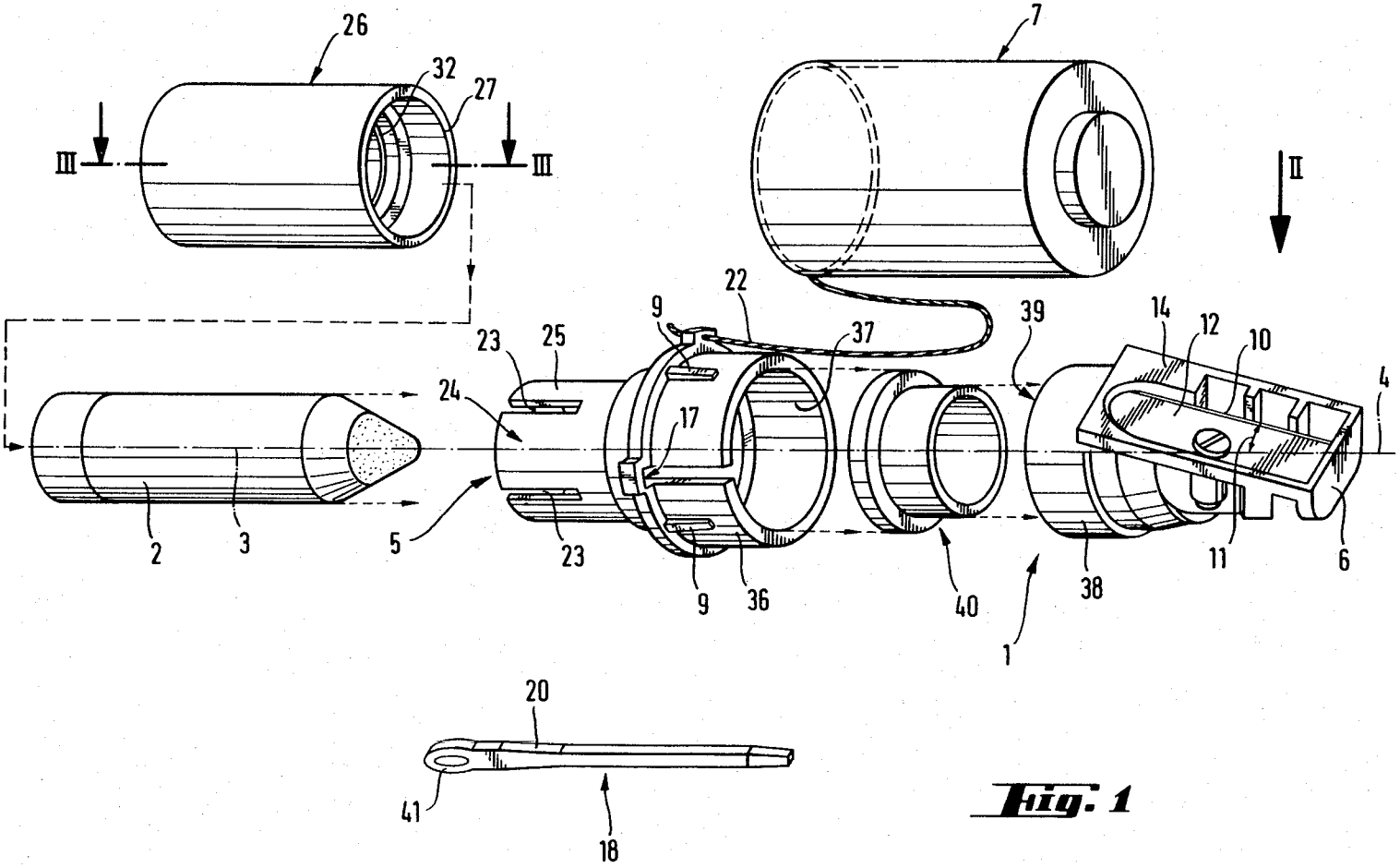
FIG. 1, an exploded perspective view of essential components of the sharpener according to the invention.

Referring to FIG. 1, the sharpener, marked as a whole with the numeral 1, can be pushed onto a writing stick having a soft interior, specifically a cosmetic stick 2, in the manner of a protective cap, particularly in a retentive or friction locking manner, and can be rotated about the axis 4 of the sharpener which is coaxial with the axis 3 of the stick so as to perform the sharpening operation. The sharpener 1 is provided with a chip collecting cap 7 which can be fixed on the sharpener and encloses the sharpening end 6 facing away from the stick-side insertion end 5. When in the released position, in which the chip collecting cap 7 is pulled slightly away from the fixed position shown in FIGS. 2 and 4 in the direction opposite to arrow 8, the chip collecting cap 7 can be rotated with respect to the sharpener 1 about the sharpener axis 4. In order to place the chip collecting cap onto the sharpener 1 in a retentive or friction locking manner, wedge-shaped attachment ribs 9 are provided in uniform distribution over the circumference of the sharpener. These ribs 9 become effective in a retentive or friction locking manner only shortly before the chip collecting cap 7 reaches the inserted end position. A slight removal of the chip collecting cap 7 in the direction opposite to arrow 8 is sufficient to permit relative rotation of the chip collecting cap 7 with respect to sharpener 1.

Figure 2:
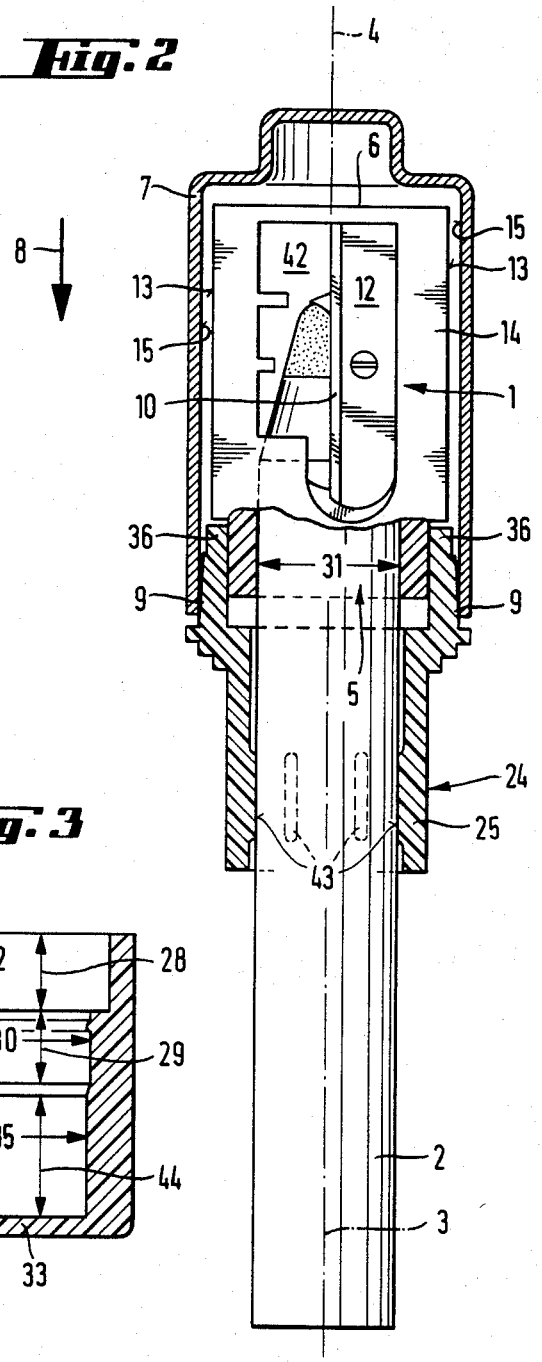
FIG. 2, a side elevational view, partially in cross section, of the sharpener in the use position according to arrow II of FIG. 1

Sharpener 1 is provided with a sharpening blade 12 whose cutting edge 10 is placed at an acute angle (angle 11) with respect to the sharpener axis 4. According to one embodiment of the invention, as shown in FIG. 2, both side edges 13 of the basic body 14 of sharpener 1 supporting the sharpening blade 12 extend approximately parallel to the interior wall 15 of the chip collecting cap 7 flanking the basic body 14. The side edges 13 extend approximately to the interior wall 15 of the rotationally symmetrical chip collecting cap 7 and extend on both sides beyond the length of the sharpening blade 12 1 measured in the longitudinal direction of the sharpener axis 4. They extend essentially over the entire axial receiving length 16 of the chip collecting cap 7. The side edges 13 extend approximately in the plane of sharpening blade 12 and project toward the adjacent interior wall 15.

FIGS, 1, 4 and 5 show another embodiment of the invention which differs from that of FIG. 2 in that it includes a cleaning rod 18 which is pushed through a holding opening 17. The end 19 of cleaning rod 18, which is in its rest position (FIG. 4) in which it is pushed through the holding opening 17, extends approximately parallel to the interior wall 15 of the chip collecting cap 7 flanking it. It extends approximately to the interior wall 15 and projects beyond the length of the sharpening blade 12. The longitudinal extent is effective over approximately the entire receiving length 16 of the chip collecting cap 7.

In the vicinity of the gripping end 41 the side of the cleaning rod 18 flanking the interior wall 15 is provided with a wedge-shaped slope 20 This slope 20 is tapered in the insertion direction and, in the inserted end position, it rests with a press fit against a corresponding counterface on the interior wall 15 of the chip collecting cap 7, thus additionally producing a clamping connection between sharpener 1 and chip collecting cap 7.

Figure 5:
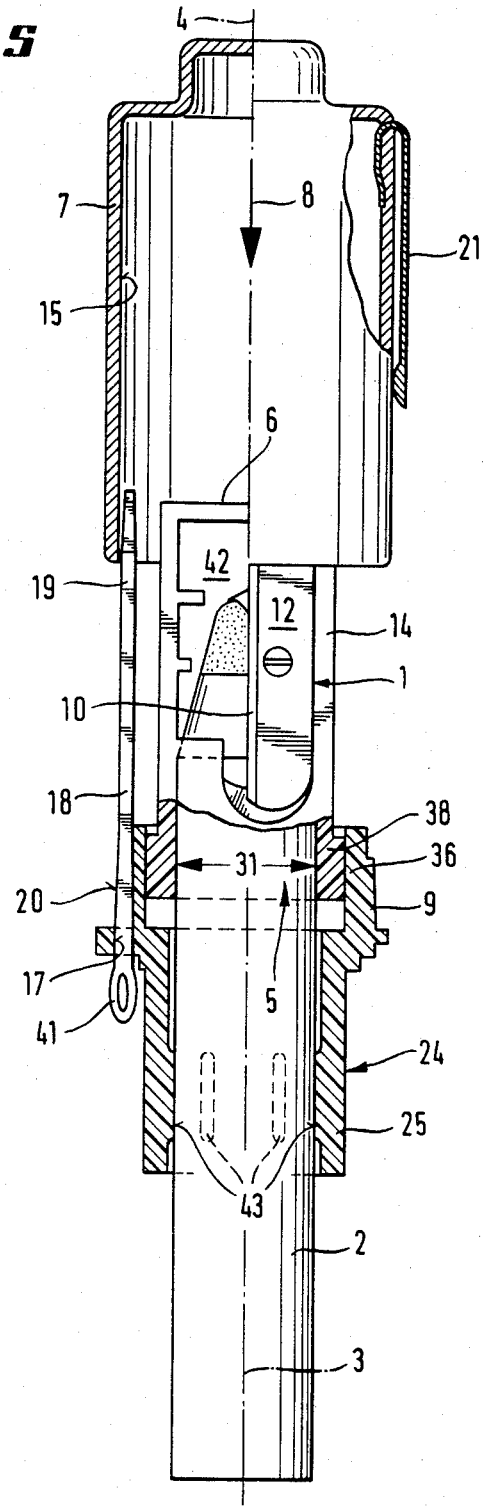
FIG. 5, a side elevation view in partial cross section showing the sharpener of FIG. 4 essentially pulled away from the chip collecting cap.

As shown in FIG. 5, the chip collecting cap 7 may be provided with a clip 21. Additionally, as shown in FIG. 1, cap 7 may be fastened to the sharpener 1, for example by means of a plastic cord 22 in a manner disclosed in German Offenlegungsschrift No. 2,734,695, so as to secure it against loss, without thus impeding its removability from sharpener 1.

By means of an extension 24 which has an insertion end 5 formed on the stick side and is provided, in particular, with longitudinal slits 23, the sharpener 1 can be placed onto stick 2. The longitudinal slits 23 form radially resilient laminae 25 which assure a retentive friction fit with the required effectiveness even on sticks 2 whose diameter varies within certain tolerance ranges. A plurality of slide and clamp humps 43 are uniformly distributed over the inner circumference of laminae 25. Humps 43 project radially inwardly and are preferably oriented along the longitudinal direction of the sharpener.

Figure 3:
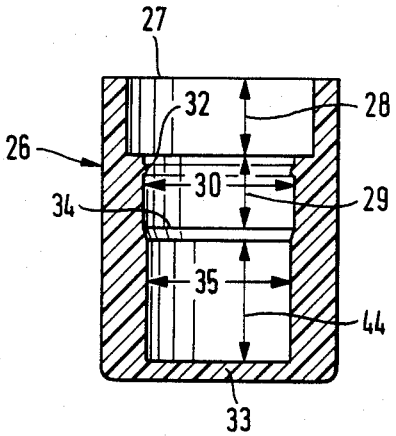
FIG. 3, a cross-sectional view in partial elevation along line III—III through the closing cap shown in FIG. 1.

The insertion end 5 of sharpener 1 or of its extension 24, respectively, can be closed by means of an attachable closing cap 26 so as to protect it against chips. The closing cap 26 has approximately the shape of a hollow cylinder closed at one end. Moreover, and with reference to FIG. 3, in a longitudinal region 29 spaced from its attachment end 27 (distance 28) the closing cap has an inner circumferential region whose diameter 30 corresponds approximately to the rated diameter 31 of the sharpener with tight fit. This tight fit may also be enhanced, for example, by a raised portion 32 formed at the inner circumference of longitudinal region 29.

In its region adjacent the closing end 33, the closing cap 7 is provided with an annular ledge 34 which acts as an insertion stop. The hollow cylinder region disposed between the annular ledge 34 and the closing end 33 which, due to its length does not contact the the soft interior at the tip of the stick, has a diameter 35 which is smaller than the rated diameter 31 of the sharpener.

Referring again to FIG. 1, the basic body 14 holding the sharpening blade 12 is made of several parts and comprises a guide sleeve 36 having a cylindrical stick guiding ring 37 and a rotationally securely attachable blade supporting member 38. An adapter sleeve 40 can be inserted into the stick insertion opening 39 of the blade supporting member 38.

After slightly loosening the seat of the chip collecting sleeve 7, the latter can be rotated with respect to the sharpener 1 about the sharpener axis 4 so that the side edges 13 (FIG. 2) scrape away or carry along, respectively, any sharpening waste possibly adhering to the interior wall 15 of the chip collecting cap 7 and deposit it on the surface of the basic body 14. After complete removal of the sharpener from the chip collecting cap 7, this sharpening waste can easily be stripped off, for example onto toilet paper.

Figure 4:
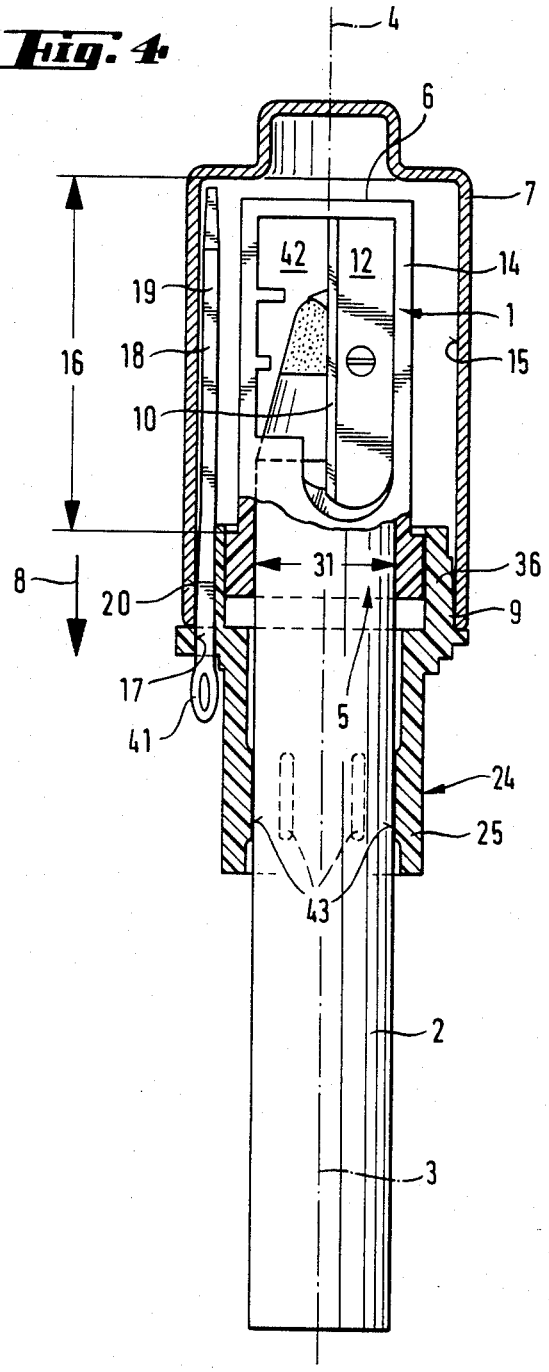
FIG. 4, side elevational view, in partial section of a a modified embodiment of the sharpener.

In the embodiment of FIGS. 1, 4 and 5, the cleaning rod, when in its inserted end position (FIG. 4), initially produces a firm twist lock between chip collecting cap 7 and sharpener 1. Thus, insertion ribs 9, for example, are not essential in this embodiment, to produce a rotationally secure fix of the chip collecting cap 7 and can be omitted. If then sharpening waste is to be removed from the chip collecting cap, the cleaning rod 18 is merely pulled slightly in the direction of arrow 8 until the rotationally secure adhesive lock effect has been cancelled. Then the chip collecting cap 7 is rotated relative to the sharpener 1. The cleaning rod 18 takes along sharpening waste adhering to the interior wall 15 of the chip collecting cap 7 or scrapes it off, so to speak. If then the entire sharpener is pulled out of the chip collecting cap 7, the sharpening waste lies on the cleaning rod 18 and on the adjacent portion of basic body 14 of sharpener 1. If now, after gripping the clean gripping end 41, the cleaning rod 18 is pulled completely out of the holding opening 17 in sharpener 1, the holding opening 17 strips off sharpening waste adhering to end 19 of cleaning rod 18. Now, the thus cleaned cleaning rod 18 can be used to strip off the sharpening waste adhering to the basic body 14 or to the sharpening blade 12. Moreover, it can serve its intended purpose of cleaning the sharpening gap 42 between cutting blade edge 10 and the opposite wall of basic body 14.

I claim:

1. A sharpener for sharpening an end of a writing stick which has a soft interior, sharpening being effected by inserting the writing stick into the sharpener and rotating the sharpener and the writing stick relative to each other, the sharpening of the writing stick generating waste material, said sharpener comprising:

a sharpener body having an insertion end with an opening for receiving the end of the writing stick and a longitudinal axis extending through the opening;

a sharpener blade mounted on said body and having a cutting edge arranged at an acute angle with respect to the longitudinal axis of said body;

a chip collecting cap having an interior wall and removably mounted on said body for enclosing an end of said body remote from said insertion end, said chip collecting cap being movable relative to said body between a secure position in which it is secured against rotation relative to said body and a released position in which it is rotatable relative to, and about the longitudinal axis of, said body; and means defining a cleaning projection supported by said body, extending parallel to the longitudinal axis of said body into said chip collecting cap and being adjacent the interior wall of said chip collecting cap for scraping waste material from said interior wall when said chip collecting cap is rotated relative to said sharpening body.

2. A sharpener according to claim 1, wherein said sharpener body is provided with a mounting aperture and said means defining a cleaning projection is a releasably fastened cleaning rod which is insertable into the mounting aperture for mounting in a rest position; said cleaning rod, when in the rest position, extending approximately parallel to the interior wall of said chip collecting cap flanking said rod and projecting to approximately the interior wall of said chip collecting cap.

3. A sharpener according to claim 2, wherein said cleaning rod extends essentially over the entire length of said chip collecting cap.

4. A sharpener according to claim 2, wherein said cleaning rod has at least one side which faces said interior wall of said cap and which has a wedge-shaped sloped face, and said chip collecting cap has a counterface corresponding to said side so that when said cleaning rod is fully inserted in said mounting aperture, said cleaning rod rests in a press fit against the corresponding counterface of said chip collecting cap.

5. A sharpener according to claim 1, wherein said chip collecting cap has an axially symmetrical interior cross section.

6. A sharpener according to claim 5, wherein the interior cross section of said cap is cylindrical.

7. A sharpener according to claim 1, further comprising a clip carried by said cap.

8. A sharpener according to claim 1, further comprising a pull-apart connecting means for connecting said chip collecting cap and said sharpener body even when said chip collecting cap is removed from said sharpener body.

9. A sharpener according to claim 1, wherein said body includes a projecting sleeve disposed at said insertion end, said sleeve defining the opening in said sharpener body into which the writing stick is inserted.

10. A sharpener according to claim 9, wherein said projecting sleeve has slits parallel to the direction of the longitudinal axis of said sharpener body.

11. A sharpener according to claim 10, wherein said projecting sleeve includes a plurality of slide-and-clamp humps which are uniformly distributed over the inner circumference of said projecting sleeve, project radially inwardly and are oriented along the longitudinal direction of said sharpener body.

12. A sharpener according to claim 1, wherein said sharpener body has an outer circumferential region and further including a sealing cap having an inner circumferential region with a raised portion, said sealing cap being removably disposed at said insertion end for sealing said insertion end tight against the waste material, and said raised portion facilitating adhesion to the outer circumferential region of said sharpener body.

13. A sharpener according to claim 12, wherein said sealing cap has the shape of a hollow cylinder closed at one end.

14. A sharpener according to claim 13, wherein said sealing cap has an open end opposite said closed end, the outer circumferential region of said sharpener body has a given diameter, and the inner circumferential region of said sealing cap is spaced from said open end and has a diameter corresponding approximately to the given diameter of said sharpener body for forming a tight fit between said sealing cap and said sharpener body.

15. A sharpener according to claim 14, wherein said sealing cap is provided at a region adjacent its closed end with an annular ledge which constitutes an insertion stop and the region lying between said annular ledge and said closed end has the form of a closed cylinder with a diameter which is smaller than the given diameter of the outer circumferential region of said sharpener body and a length which prevents placing a tip portion of the stick onto said closed end so that said sealing cap can be used as a protective cap for the tip portion of the stick when the stick is removed from said sharpener body.

16. A sharpener according to claim 1, wherein said sharpener body is composed of a plurality of parts including a guide sleeve having a cylindrial stick guiding ring and a blade supporting member attachable to said guiding ring so that said blade supporting member is secure against rotation relative to said guide sleeve.

17. A sharpener according to claim 16, wherein said parts further include an adapter sleeve constructed to be inserted into said stick guiding ring or into said blade supporting member.

* * * * *